United States Patent [19]

Porter

[11] 4,324,333

[45] Apr. 13, 1982

[54] TRANSPORTATION OF FLUENT MATERIAL

[75] Inventor: Harold Porter, Tallentyre, England

[73] Assignee: Porter Chadburn Limited, Bootle, England

[21] Appl. No.: 189,953

[22] PCT Filed: Jun. 1, 1979

[86] PCT No.: PCT/GB79/00096

§ 371 Date: Feb. 3, 1980

§ 102(e) Date: Jan. 24, 1980

[87] PCT Pub. No.: WO80/00019

PCT Pub. Date: Jan. 10, 1980

[30] Foreign Application Priority Data

Jun. 3, 1978 [GB] United Kingdom ..... 26317/78

[51] Int. Cl.[3] ..... B65D 85/62; B65D 77/06; B65D 19/02; B65D 5/48

[52] U.S. Cl. ..... 206/526; 206/386; 220/410; 220/462; 229/15

[58] Field of Search ..... 206/386, 526, 527; 220/410, 462; 229/15

[56] References Cited

U.S. PATENT DOCUMENTS

| | | | |
|---|---|---|---|
| 2,083,479 | 6/1937 | Speare | 206/526 |
| 2,669,351 | 2/1954 | Carson et al. | 206/526 |
| 3,082,927 | 3/1963 | Winstead | 220/410 |
| 3,143,249 | 8/1964 | Merrill et al. | 220/410 |
| 3,179,323 | 4/1965 | Miller | 220/462 |
| 3,352,472 | 11/1967 | Cummings et al. | 220/462 |
| 3,715,072 | 2/1973 | Muskopf et al. | 229/15 |
| 3,780,930 | 12/1973 | Starr | 206/386 |

*Primary Examiner*—William T. Dixson, Jr.
*Attorney, Agent, or Firm*—Townsend and Townsend

[57] ABSTRACT

A method of and a means for use in packaging bulk quantities of a fluent material for the ready transportation thereof is proposed which involves the provision of cardboard container having dividers therein separating the container into individual and adjacent compartments each containing a respective filled, flexible bag of said material, the bags substantially filling the respective compartments, and the dividers and container being such as to sustain the dynamic and static loads applied thereto during transportation.

11 Claims, 2 Drawing Figures

TRANSPORTATION OF FLUENT MATERIAL

FIELD OF THE INVENTION

The invention concerns the transportation of fluent materials, and has more particular reference to a method of packaging such materials for transportation and packaging for use in connection therewith.

BACKGROUND ART

Much attention has been directed in recent years to the provision of a means whereby liquids in bulk might be carried in containerised transport.

It has been proposed, for example, to provide a bag of rubber or the like within a container of the kind used in the containerised transport of goods, and to fill such bag with the liquid to be transported. Despite a high level of expenditure and effort, no wholly satisfactory system has been developed, a particular problem being that which arises in the event of a leakage of the bag having regard to the volume of liquid involved.

It has also been suggested, in order to provide a unit of mangeable proportions, to use one meter boxes of corrugated cardboard having a bag of synthetic plastics, material therein to receive a liquid, such proposal being particularly attractive in that the packaging is sufficiently inexpensive as to be disposable after use thus avoiding the freight costs involved in returning more substantial, and hence more expensive, containers, for example, drums, when empty. However, difficulties have arisen in connection with such units due to the static loads to which the boxes are subjected, particularly when stacked one upon another, and due to the dynamic loads arising during transportation, movement of the liquid consequent upon the dynamic forces frequently giving rise to rupture of the liner at folds in the upper regions thereof.

DISCLOSURE OF THE INVENTION

The object of the present invention is to provide a method of and a means for the transportation of fluent materials, especially liquids, which is of particular application in the context of containerised transportation.

According to one aspect of the present invention there is proposed a method of packaging fluent materials for the bulk transportation thereof, to provide a transportable module, which comprises the steps of providing a self-supporting outer container of external dimensions consistent with those of the intended module, dividing the interior of such container into a plurality of individual and adjacent compartments, locating a respective flexible bag within each such compartment, and charging each such bag in situ with the material to be transported, the dimension of each compartment, in the axial direction thereof, exceeding the transverse dimension of such compartment and the bags, when filled, fitting tightly within the respective compartments.

According to another aspect of the invention, a transportable module for use in the bulk transportation of fluent materials comprises a self-supporting outer container, one or more dividers within the outer container and defining a plurality of individual and adjacent compartments in the said container, and a filled flexible bag within each respective compartment and existing as a tight fit therein, each compartment and the bag therein having a dimension in the axial direction of the compartment in excess of the transverse dimension of such compartment.

According to a still further aspect of the invention, means for practising the method of providing a transportable module as aforesaid comprises a self-supporting outer container, at least one divider within such container and dividing the same into a plurality of individual and adjacent compartments, and a plurality of flexible bags corresponding in number to the number of compartments, the axial dimension of each compartment exceeding the dimension of such compartment in at least one transverse direction thereof, and the flexible bags being of such dimensions as, when charged with material to be transported, to be a tight fit within the respective dimension.

Preferably, the axial dimension of each compartment is not less than one and one half times the said transverse dimension.

According to a further preferred feature the outer container is rectangular and measures approximately one meter in each direction, and is divided into four individual compartments.

BRIEF DESCRIPTION OF THE DRAWINGS

The invention will now be described further, by way of example only, with reference to the accompanying drawings illustrating one embodiment and in which.

BEST MODE FOR CARRYING OUT THE INVENTION

Figure 1:
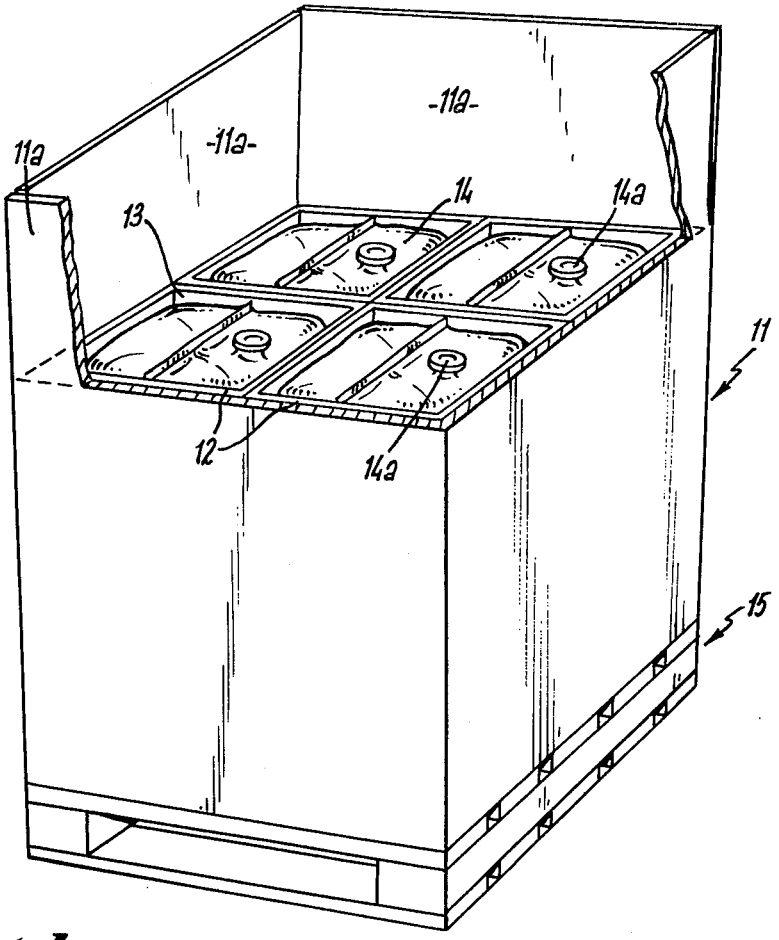
FIG. 1 is a broken away perspective view of a transportation module constructed in accordance with the invention.

Referring now to the drawings, and particularly to FIG. 1 thereof, a transportation module for use in the transportation, in bulk, of fluent materials, particularly liquids, comprises an outer container 11 of rectangular form, a plurality of dividers 12 within such container and defining side-by-side compartments 13 therein, and a respective flexible bag 14 within each compartment.

The outer container comprises a cardboard box of one meter side constructed from five-ply corrugated board, the box having closure flaps 11*a*, of which two are shown cut away, in conventional manner.

Each divider, there being four dividers in the embodiment illustrated, is in the form of an open-ended tube of square cross-section and of a length equal to the height of the box, the transverse dimension being equal to one half of the corresponding dimension of the box. As with the box, so too are the dividers 12 fabricated from five-ply corrugated board, the corrugations of the material of the box and of the dividers being mutually inclined at an angle of 90°. When positioned in the box 11, the dividers 12 are a close fit therein and such dividers extend to the plane of the open-end of the box.

The flexible bags 14 are of conventional form and are produced from extruded plastics tube by transversely seaming a flat tube at spaced intervals and severing the tube to provide discrete bags, there being an inlet spout 14*a* applied to the outer surface of the bag through which the bag is filled. In the arrangement illustrated the bag is typically thirty-four inches wide and fifty-four inches long, and is fabricated from polythene.

The outer container is supported on a pallet 15, and is preferably secured thereto as by a metal band extending about the container and pallet.

In the embodiment illustrated the weight of each bag, when filled, will be approximately 250 kgs, thus to give a total weight for the container of approximately 1000 kgs.

The dimensions of the container are such that the container can readily be packed in a standard transportation container to effect maximum utilisation of the capacity thereof.

We have found that by limiting the transverse dimensions of the compartment it is possible to provide a structure of sufficient strength to sustain the loads, both static and dynamic, to which the same will be subjected during normal transportation of the liquid, the strength being derived partly from the material of the outer container and partly from that of the dividers, the material between adjacent bags, in the embodiment shown, being of like thickness to that of the peripheral walls supporting the bag. The limited transverse dimensions of each compartment further restrict the dynamic forces acting on the bag, and thus reduce the possibility of mechanical damage and rupture of the bag due to continued flexing thereof in any regions of fold which occur.

Whilst the provision of dividers in the form of open-ended tubes is convenient, in that it readily provides for a like wall thickness as between adjacent bags and outwardly of each bag, a divider of cruciform shape may be preferred in some circumstances.

In addition to defining separate compartments in the outer container, which container may have the walls thereof formed as mesh-like structures rather than the imperforate surfaces shown, the dividers fulfil the further function of constituting load bearing elements to support modules arranged one upon another.

Figure 2:
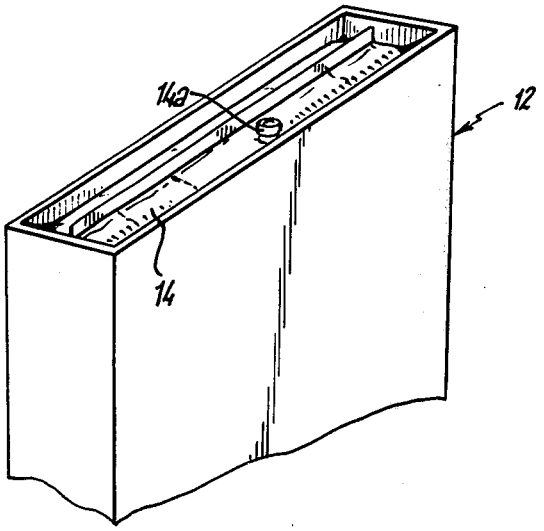
FIG. 2 is a perspective view of a part of an alternative divider to that shown in FIG. 1.

The dividers, whether of the tubular form herein-disclosed or otherwise, may be of rectangular transverse cross-section, as in FIG. 2, the dimensional limitations of the compartment arising from a small thickness dimension of the divider ensuring satisfactory support of the filled bag.

As will be appreciated, the arrangement as hereinproposed does allow of the transportation of liquids in bulk by conventional containerised transport, the containers of the invention being inexpensive in manufacture and generally disposable having regard to the materials from which such containers are fabricated. The complete isolation of the material being transported from contact with the interior of the containerised transport unit allowing of the immediate use of such unit for other products, for a return journey.

The plastics bags proposed to be used are, by virtue of their method of manner, sterile, and thus, the system and means hereinproposed is of application in contexts where sterility is of importance. A typical context in which the invention is of application is in the transportation of liquid chemicals, although liquids might advantageously be transported in the manner proposed. Indeed, it is not thought that the invention is limited in its application to the context of liquids, since some powders or particulate materials may advantageously be transported in the manner proposed, especially if the maintaining of sterilised conditions is of paramount importance.

If further strengthening of the container is desirable especially for stacking purposes, this can be effected by means of wooden struts provided internally or externally of the box, such struts, in the latter case, being located within the dimensions of the pallet.

I claim:

1. A method of packaging fluent materials for the bulk transportation thereof, to provide a transportable module, which comprises the steps of providing a self-supporting outer cardboard container of external dimensions consistent with those of the intended module, dividing the interior of such container into a plurality of individual and adjacent compartments by means of a plurality of adjacent mutually supporting cardboard dividers of tubular form whereby the walls separating adjacent compartments are of a multiple thickness substantially equal to the like multiple thickness walls existing between a compartment and the exterior of the outer container, locating a respective flexible bag within each such compartment, each bag having a closable inlet provided therein, and charging each such bag in situ with the material to be transported, the dimension of each compartment, in the axial direction thereof, exceeding the transverse dimension of such compartment and the bags, when filled, expanding to fit tightly within the respective compartments.

2. A transportable module for the bulk transportation of fluent materials comprising a self-supporting outer cardboard container, a plurality of adjacent mutually supporting cardboard dividers of tubular form within the outer container and defining a plurality of individual and adjacent compartments in the said container, whereby there are walls separating adjacent compartments which are of a multiple thickness substantially equal to like multiple thickness walls existing between a compartment and the exterior of the outer container, and a filled flexible bag having a closable inlet provided therein disposed within each respective compartment and existing as a tight fit therein, each compartment and the bag therein having a dimension in the axial direction of the compartment in excess of the transverse dimension of such compartment.

3. A transportable module as claimed in claim 2, wherein each divider is of retangular form when viewed in transverse cross-section.

4. A transportable module as claimed in claim 2, wherein the outer container comprises a cube of one meter side.

5. A transportable module as claimed in claim 2, wherein the dividers extend throughout substantially the full height of the outer container.

6. A transportable module as claimed in claim 2, wherein the outer container is fabricated from multi-ply corrugated board.

7. A transportable module as claimed in claim 6, wherein each divider is fabricated from multi-ply corrugated board.

8. A transportable module as claimed in claims 6 or 7, wherein the said corrugated board is five-ply corrugated board.

9. A transportable module as claimed in claim 7, wherein the corrugations of the material forming the outer container and the corrugations of the dividers are mutually inclined at an angle of 90°.

10. A transportable module as claimed in claim 2, wherein each compartment has a dimension in the axial direction thereof not less than one and one half times the transverse dimensions of the compartment.

11. A transportable module for the bulk transportation of fluent materials comprising a self-supporting outer cardboard container in the form of a cube of not substantially less than about one meter sides, a plurality of adjacent mutually supporting cardboard dividers of tubular form within the outer container and defining a plurality of individual and adjacent compartments in the said container whereby there are walls separating adjacent compartments which are of a multiple thickness substantially equal to like multiple thickness walls existing between a compartment and the exterior of the outer container, and a filled flexible bag having a closable inlet provided therein disposed within each respective compartment and existing as a tight fit therein, each compartment and the bag therein having a dimension in the axial direction of the compartment not less than one and one-half times the transverse dimension of such compartment.

* * * * *